United States Patent [19]

Wilmot

[11] Patent Number: 4,597,512

[45] Date of Patent: Jul. 1, 1986

[54] AEROSOL VALVES

[75] Inventor: Kenneth Wilmot, Clitheroe, England

[73] Assignee: Neotechnic Engineering Limited, Lancashire, England

[21] Appl. No.: 506,161

[22] Filed: Jun. 20, 1983

[30] Foreign Application Priority Data

Aug. 6, 1982 [GB] United Kingdom ..... 8222670
Aug. 20, 1982 [GB] United Kingdom ..... 8224022

[51] Int. Cl.[4] ..... B65D 83/14
[52] U.S. Cl. ..... 222/402.2; 222/402.24
[58] Field of Search ..... 222/402.2, 402.16, 402.24; 251/353, 354

[56] References Cited

U.S. PATENT DOCUMENTS

| | | | |
|---|---|---|---|
| 2,980,301 | 4/1961 | DeGorter | 222/402.2 |
| 3,385,482 | 5/1968 | Frangos | 222/402.24 X |
| 3,710,990 | 1/1973 | Lazarus | 222/402.24 |
| 3,738,542 | 6/1973 | Ruscitti | 222/402.2 X |
| 3,854,636 | 12/1974 | Conway et al. | 222/402.24 |
| 4,220,265 | 9/1980 | Shay | 222/402.2 |
| 4,362,257 | 12/1982 | Shay | 222/402.2 |
| 4,427,137 | 1/1984 | Dubini | 222/402.2 |

*Primary Examiner*—Charles A. Marmor

*Attorney, Agent, or Firm*—Seidel, Gonda, Goldhammer & Abbott

[57] ABSTRACT

An aerosol valve (3) for dispensing metered fluid doses from an aerosol container, comprising a valve body (4) at least partially defining a metering chamber (9) and a valve stem (6) operably movable between inoperative and operative positions against a bias, the stem (6) having a seal (16) mounted thereon and arranged to seal an inlet duct (18) of the metering chamber (9) when the valve stem (6) is in its operative position. In a preferred embodiment, the valve stem (6) has first and second portions (7,8) with the seal (16) mounted upon the second portion (8). In this particular arrangement, and when the valve stem (6) is in its inoperative position, an outlet duct (12) associated with the metering chamber (9) is sealed therefrom and the inlet duct (18) is open, whereby fluid to be dispensed in a metered dose can flow or be drawn into the metering chamber (9). When the valve stem (6) is in its operative position, the seal (16) is in sealing engagement with the inlet duct (18) and the outlet duct (12), of the first stem portion (7), is in communication with the metering chamber (9), whereby a metered dose of fluid can be dispensed therefrom. When the valve stem (6) is in its filling position, the seal (16) passes completely through and out of the inlet duct (18) to provide a passageway for the charging fluid unobstructed by the seal (16).

12 Claims, 10 Drawing Figures

FIG.1.
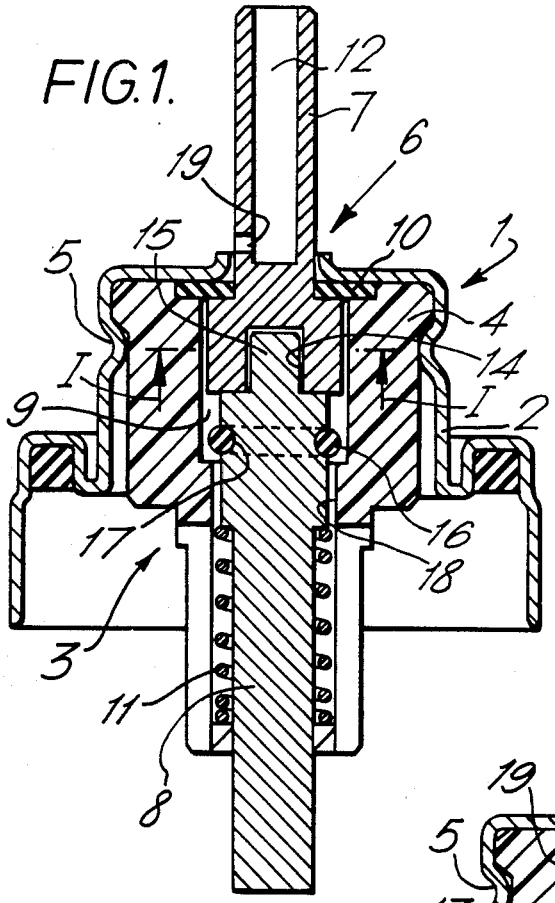
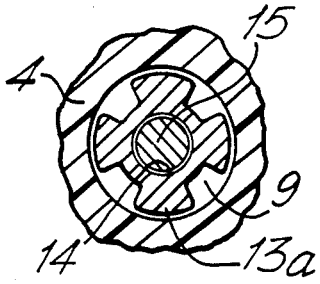
FIG.1a.
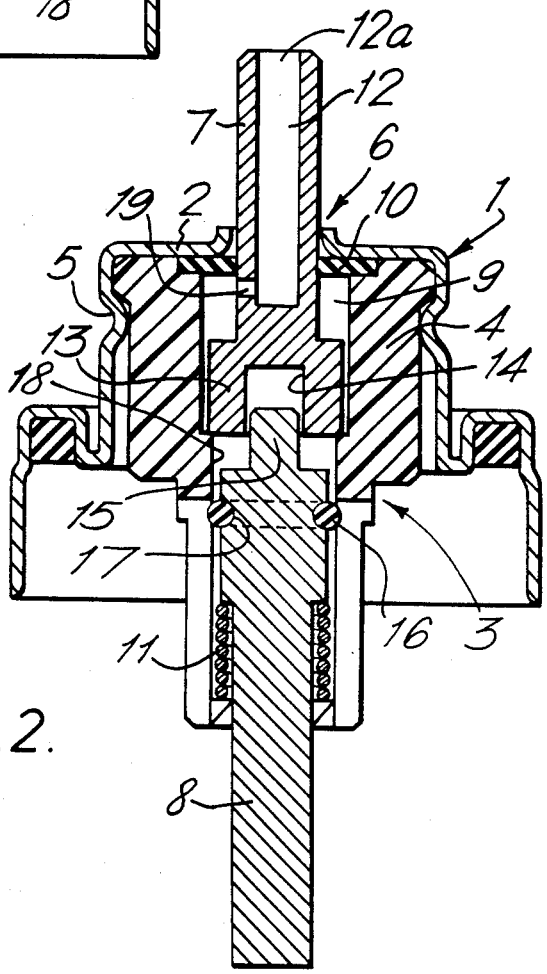
FIG.2.

FIG.7.
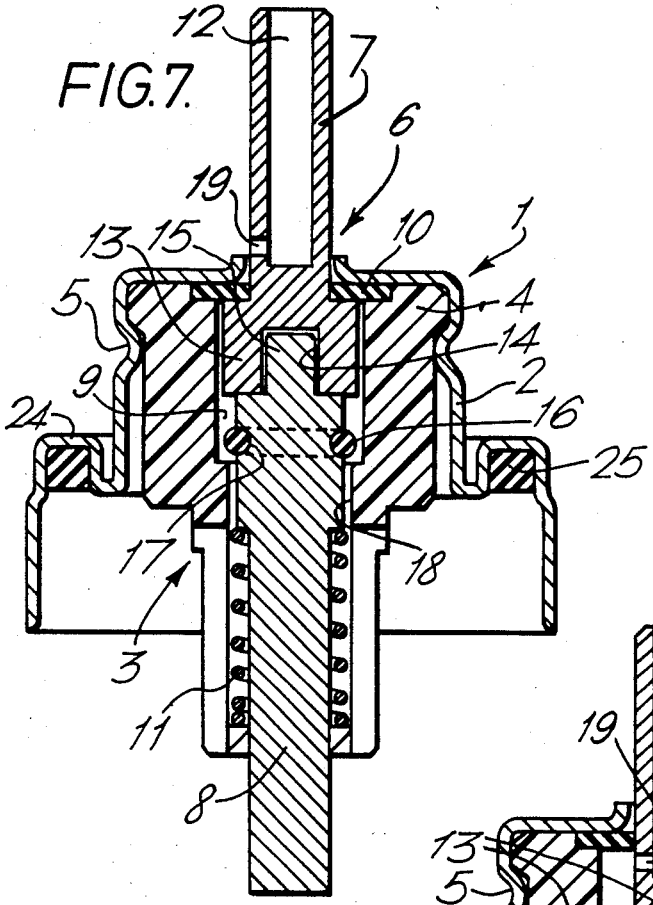
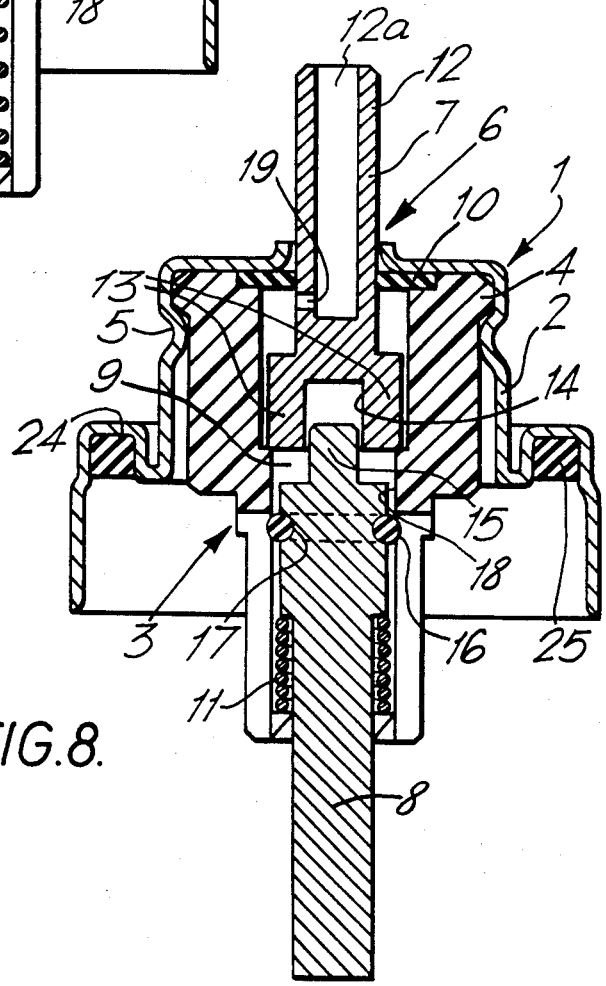
FIG.8.

AEROSOL VALVES

DESCRIPTION

This invention relates to a valve for dispensing metered fluid doses from an aerosol container and is especially, but not exclusively, concerned with such a valve constructed so as to facilitate the filling of an aerosol container, to which the valve is attached, with fluid to be dispensed.

In accordance with one aspect of the invention, a valve for dispensing metered fluid doses from an aerosol container, comprises a valve body at least partially defining a metering chamber and a valve stem operably movable between inoperative and operative positions against a bias, the stem having a seal mounted thereon and arranged to seal an inlet duct of the metering chamber when the valve stem is in its operative position.

In accordance with a second aspect of the invention, an aerosol valve for dispensing metered fluid doses from an aerosol container comprises a valve body having a metering chamber therein with an inlet duct, an associated seal fixed in the body and a valve stem which is slidably movable with respect to the body between inoperative and operative positions against a bias, the valve stem comprising a first portion in sliding sealing engagement with the first seal and having an outlet duct and a second portion having a seal mounted thereon and arranged to engage sealingly with the inlet duct of the metering chamber in the operative position of the valve stem, the arrangement being such that, when the valve stem is in its inoperative position, the outlet duct is sealed from the metering chamber and the inlet duct is open, whereby fluid to be dispensed in a metered dose can flow or be drawn into the metering chamber and that, when the valve stem is in its operative position, the seal mounted upon the second portion of the valve stem is in sealing engagement with the inlet duct of the metering chamber and the outlet duct of the first portion of the valve stem is in communication with the metering chamber, whereby a metered dose of fluid is dispensed therefrom.

Preferably, the first and second portions of the valve stem are separable and, in a preferred embodiment of the valve of the invention, the second portion of the stem is movable to a filling position, with the first portion being maintained in its operative position. It has been found that, with this arrangement, an aerosol container to which the valve is attached can be filled with fluid at substantially lower pressures than those used for filling containers fitted with some conventional valves where much higher filling pressures have to be employed. With this embodiment, where the second stem portion is movable into a further filling position, much lower filling pressures can be used.

The bias, against which the valve stem has to be moved between its inoperative and operative positions, can be provided by any suitable means. For example, a spring may be incorporated in the valve to act between the stem and body, thereby urging the stem into its inoperative position when the valve is not in use. Any suitable spring arrangement may be employed, but in a preferred embodiment a compression spring is located within the body to act against the second portion of the valve stem. In this case, it is merely the compressional force of the spring and the residual pressure in the container which have to be overcome in order for the second stem portion to be moved into its filling position.

Alternatively, a tension spring may be located within the metering chamber, to act between the second portion of the valve stem and an abutment surface associated with the valve body or a ferrule to which the body is secured.

The metering chamber is preferably defined by the corresponding inner surfaces of the valve body and the associated surfaces of the valve stem. Advantageously, the first portion of the stem is at least partially castellated, to facilitate the filling operation, by providing comparatively large recesses between adjacent castellations, whereby the flow of filling fluid from the outlet duct, through the metering chamber and then into the container via the inlet duct, with the second portion of the valve stem in its filling position, is considerably enhanced.

The components of the valve may be made of any suitable material, for example, nylon, stainless steel or a combination thereof. In one embodiment, in which the valve body is made of nylon, the inner surfaces of the metering chamber are provided with a stainless steel liner.

In order that the invention may be more fully understood, various preferred forms of aerosol valve in accordance with the invention are described below by way of example, with reference to the accompanying drawings, in which the same or similar parts in the various constructions shown are denoted with the same references; in the drawings:

FIG. 1 shows a vertical sectional view of an aerosol valve with the valve in the inoperative position;

FIG. 1*a* is a fragmentary cross-section of the valve stem on the line I—I, showing castellations thereon;

FIG. 2 shows the valve of FIG. 1 with a second portion of the valve stem in a filling position and a first portion of the valve stem in an operative position for filling purposes;

Figure 5:
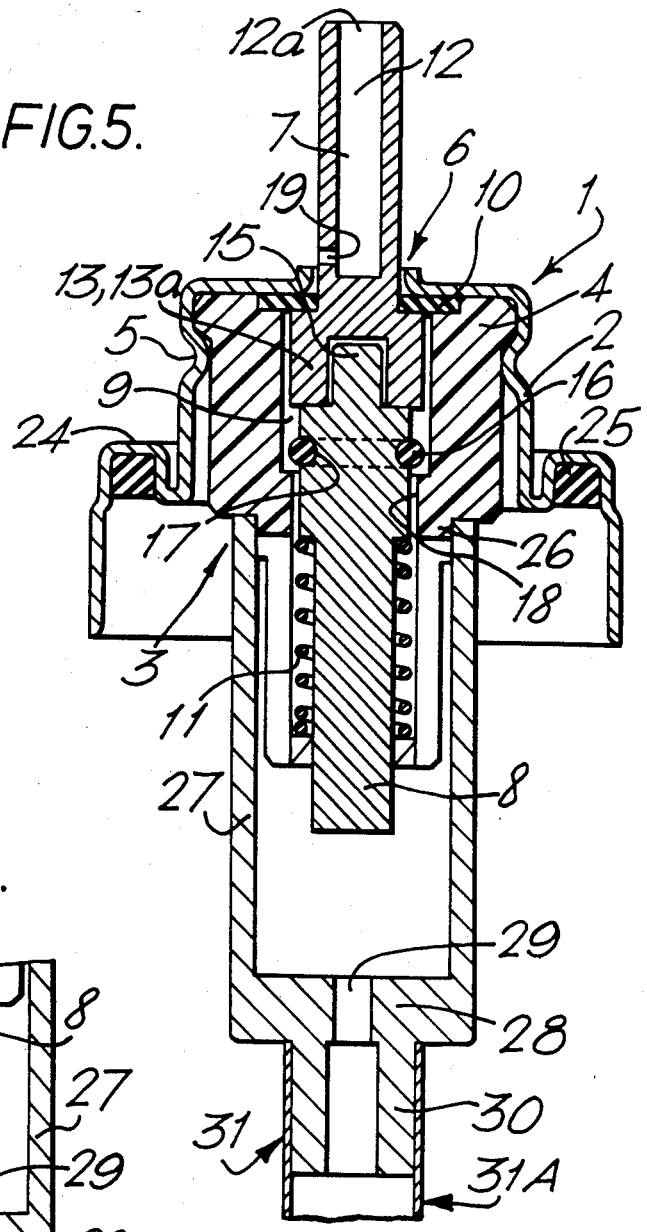
FIG. 5 shows another form of valve of the kind shown in FIG. 4, with a diptube fitted.
Figure 5A:
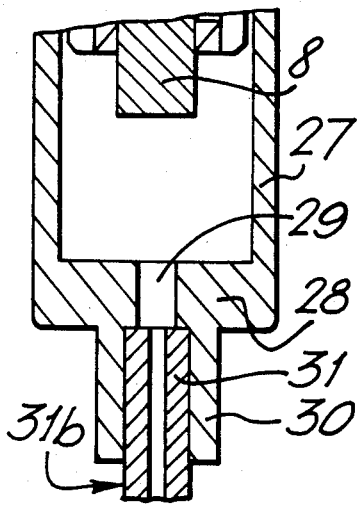
Figure 6:
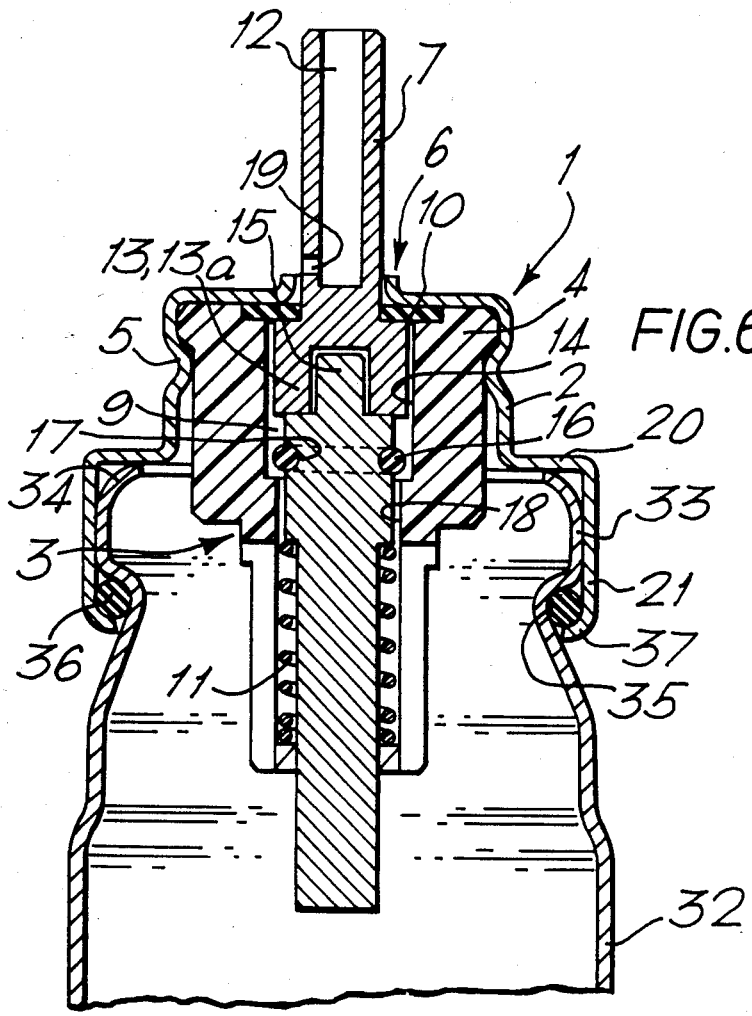

FIG. 5*a* shows a variant of the valve of FIG. 5, where the diptube is of capillary form;

FIG. 6 shows a view of a form of valve modified for attachment to an aerosol container with an O-ring shoulder seal;

FIG. 7 shows the valve of FIG. 5 without the diptube fitting and with the valve parts in the normal position;

FIG. 8 shows the valve of FIG. 7 with the valve parts in the pressure filling position.

Referring firstly to FIG. 1, a valve assembly 1, for attachment to an aerosol container, comprises a metal ferrule 2 and a valve 3 consisting of a valve body 4, to which the ferrule is crimped at 5, and a valve stem 6 comprising first and second portions 7, 8. The valve stem is slidably movable with respect to the body 4, between inoperative and operative positions against a bias provided by a spring 11.

The valve body 4 has a metering chamber 9 therewithin and a fixed seal 10 associated with this chamber. The upper part of the first stem portion 7 is slidably and sealingly engaged with the fixed seal 10, such that, in the inoperative position of the valve 3 as shown in FIG. 1, an outlet duct 12 is not in communication with the metering chamber 9. As shown in FIG. 1*a*, the lower part 13 of the first portion 7 of the stem 6 is castellated about its periphery. FIG. 1*a* shows the lower part of the valve stem portion 7 with four castellations 13*a* alternating with passageways which form major parts of the volume of the metering chamber 9. Also, this lower part 13 of the first stem portion 7 has a recess 14 in which is received a reduced diameter part 15 of the second stem portion 8. An O-ring seal 16 is mounted upon the second stem portion 8 in a groove 17, and is arranged, in the operative position of the valve, to engage sealingly with an inlet duct 18 for the metering chamber 9 passing through the lower wall of the body 4.

Thus, when the valve stem 6 is in its inoperative position, as shown in FIG. 1, the associated outlet duct 12 does not communicate with the metering chamber 9 and the O-ring seal 16 upon the second stem portion 8 is not in engagement with the inlet duct 18. As a consequence, and on inversion of the valve, fluid to be dispensed therefrom flows, under gravity, through the inlet duct 18 and fills the metering chamber 9.

On subsequent movement of the stem 6 to its operative position (in which the first valve stem portion 7 is positioned as shown in FIG. 2 and the second portion 8 is in contact with it), the O-ring seal 16 is brought into sealing engagement with the inlet duct 18 and the outlet duct 12 is brought into communication with the metering chamber 9, with an auxiliary port (or ports) 19 being positioned below the fixed seal 10. Such movement of the stem 6 from its inoperative to its operative positions is, as mentioned above, against the bias of the compression spring 11.

In this operative position of the valve stem 6, the metered dose of fluid in the metering chamber 9 is expelled through the outlet duct 12 via the one or more auxiliary ports 19. On returning the valve stem 6 to its inoperative position, as a result of the biasing action of the helical spring 11, the valve assumes its initial configuration, as shown in FIG. 1.

Referring now to FIG. 2, here the valve 3 is shown with the second portion 8 of the valve stem 6 in a filling position.

The filling operation for the aerosol container (not shown), to which the valve assembly 1 is attached via the ferrule 2, is effected by connecting the head of a pressurised fluid supply to the open end 12*a* of the outlet duct 12. Initially, the valve stem 6 is moved into its operative position, by means of a corresponding movement of the head of the connected fluid supply, with the outlet duct 12 in communication with the metering chamber 9, via the auxiliary port 19, and with the O-ring seal 16 sealingly engaging with the inlet duct 18. Immediately thereafter, the pressure of the fluid supply moves the second stem portion 8 further downwardly until the O-ring seal 16 is passed completely through the inlet duct 18, such that the seal 16 assumes the position shown in FIG. 2. In this manner, a passageway is provided for the filling fluid from the end 12*a* of the outlet duct 12 to the interior of the aerosol container to which the valve assembly 1 is attached. This passageway is defined by the outlet duct 12 itself, the one or more auxiliary ports 19, the spaces defined between the castellations 13*a* of the lower part 13 of the first stem portion 7 and the inner surfaces of the metering chamber 9, the length of the inlet duct 18 and the gap between the O-ring seal 16 and the lower open end of the duct 18.

It has been found that fluid filling pressures can be used which are much lower than those required when filling containers fitted with many kinds of conventional aerosol valves.

After the filling operation has been completed, the pressurised fluid supply is disconnected from the upper end 12*a* of the outlet duct 12 and, as a consequence, a combination of the pressure of the filled fluid within the container and the force of the compressed spring 11 moves both portions 7, 8 of the valve stem 6 back to their initial, inoperative positions, as shown in FIG. 1.

As indicated above, the components of the valve 3 may be made of any suitable material which is compatible with the filled fluid to be dispensed from the aerosol container. For instance, the valve body 4 may be made of nylon, the first and second stem portions 7, 8 of KEMETAL, and the fixed seal 10 and O-ring 16 of an appropriate nitrile composition.

Figure 3:
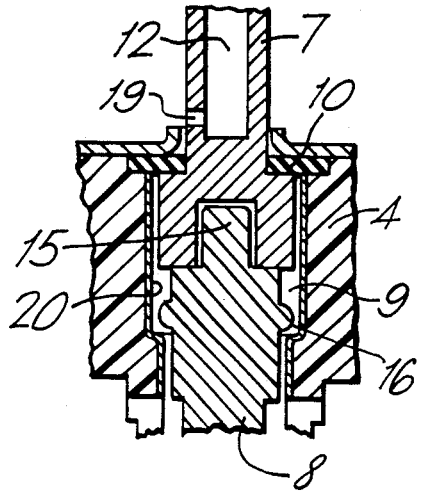
FIG. 3 shows a vertical sectional view of an alternative form of metering chamber in an aerosol of the kind shown in FIGS. 1 and 2.

In practice, all plastics components for aerosol valves are made using multi-cavity moulds and there is bound to be some variation in the individual cavities, no matter how accurate the mould toolmaking used initially. This means that there are likely to be small but non-negligible variations in the dimensions of plastics components such as valve bodies made of nylon. Another factor which can affect some plastics components is their reaction to contact with aerosol propellants. Thus, if the valve body 4 is made of nylon, in certain circumstances, the factors mentioned or possibly others may cause some alteration in the volume of the metering chamber 9, thus resulting in inaccurate dosing of the metered fluid either during the period of use of a container fitted with a valve or as between one container and another fitted with valves of nominally the same metering volume. Accordingly, an important modification of the valve 3 shown in FIGS. 1 and 2 is the provision of a stainless steel liner 20 for the metering chamber 9, as shown in FIG. 3. Otherwise, the components of the valve can be identical to those described with reference to FIGS. 1 and 2.

Also as shown in FIG. 3, and as an alternative to the O-ring seal 16, the second stem portion 8 may be integrally moulded, for instance from low-density polyethylene or some other suitable material, to provide a radial projection corresponding to the shape of the O-ring seal or to some other effective shape, such as a V-shape. Such a material would reduce the frictional forces between the seal 16 and the wall of the inlet duct 18, when the second stem portion 8 is being moved from the operative position to the filling position, as described above with reference to FIG. 2. It will be apparent that this projection can be of any shape which provides an effective sliding seal in conjunction with the inner surface of the inlet duct 18.

Various configurations for the biasing spring 11 may be used, for instance, the lower part of the second stem portion 8 need not extend through the spring 11. Alternatively, this part may be provided with a blind bore in which the spring is located or this part may be eliminated altogether, so that the other part of the second stem portion 8 rests upon the spring 11.

Figure 4:
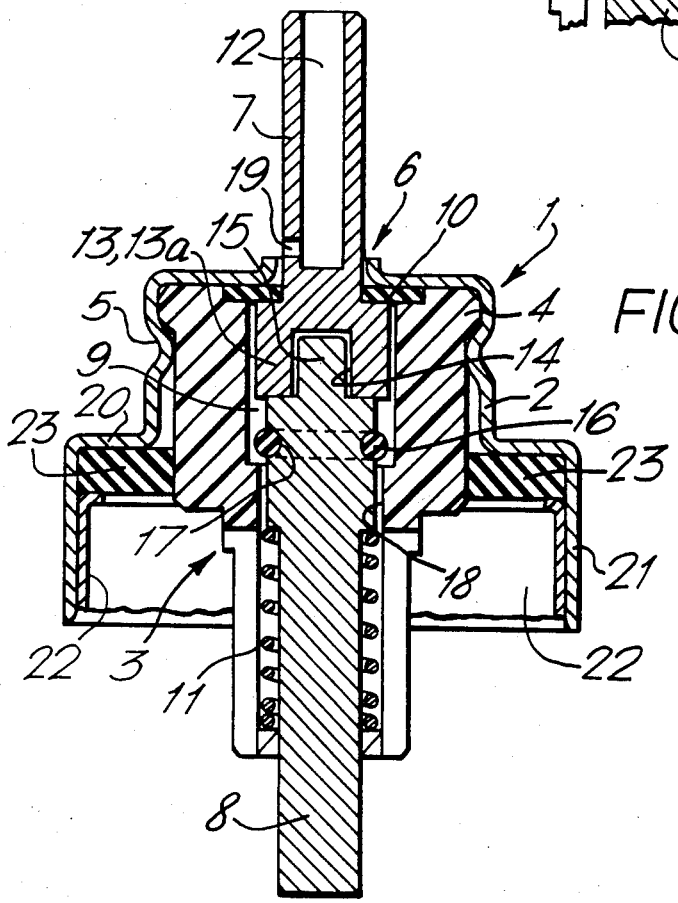
FIG. 4 shows a view similar to FIG. 1 of another embodiment of aerosol valve, for use with a diptube in a container intended to be used upright with the valve at the top.

The valve construction shown in FIG. 4 differs from that shown in FIG. 1 in that the ferrule 2 has a flat flange area 20 between the part housing the valve body 4 and the lower skirt-like part 21 for attachment to an areosol container, partly shown at 22. The top of the latter is located inside the skirt-like part 21 and is sealed to the ferrule 2 by a flat annular gasket 23, which can be made of rubber or a suitable plastics material, for instance.

Referring to FIGS. 5 and 5*a*, the aerosol valve shown has a grooved flange area 24 in the ferrule 2, between the skirt region 21 and the part surrounding the valve body 4, which forms an annular recess receiving a sealing gasket 25 of approximately square radial section, as in FIG. 1. The lower part of the valve body 4 includes a reduced diameter portion 26 which receives a tubular member 27, the open upper end of which is a press-fit on the body portion 26. At its lower end, the tubular member 27 is closed with an integral base portion 28, which contains a central inlet hole 29 and also carries a tubular extension 30 concentric with the hole 29. The extension 30 receives the upper end of a diptube 31 so that the container fitted with the valve of this type can be used in the upright position to dispense metered amounts of fluid which pass up the diptube 31, on actuation of the valve 1, to the outlet duct 12, passing via the hole 29 and the hollow interior of the tubular member 27 to the interior of the metering chamber 9. The diptube 31 can be of normal tubular form and can be fitted over the outside of the extension 30, as shown at 31*a* in FIG. 5, or it can be of capillary form and can be fitted inside the bore of the extension 30, as shown at 31*b* in FIG. 5*a*. Other means for attaching a diptube to the valve body 4 can of course be used if desired.

FIG. 6 shows a valve 1 attached to an aerosol can body 32. The ferrule 2 includes the flange 20 and the skirt-like portion 21 shown in FIG. 4 and inside the latter is fitted an upper portion 33 of the can body 32, the portion 33 being rolled inwards at 34 to abut the underside of the flange 20 when the valve 1 and the can body 32 are assembled. The can body 32 includes a groove 35 below the upper portion 33, which serves as a seat for a rubber or other O-ring seal 36 which seals the can body 32 against the inside of the ferrule portion 21. The lower rim of the ferrule portion 21 is rolled inwards into closer sealing contact with the seal 36, as shown at 37.

FIGS. 7 and 8 show the valve of FIG. 5 with the diptube fitting 27 and diptube 31 omitted, FIG. 7 showing the valve 1 in the normal position and FIG. 8 showing it in the filling position, where the second portion 8 of the valve stem has separated from the first portion 7, the part 15 sliding relative to the recess 14 as shown in FIG. 8. In this position, the first stem portion 7 has been depressed so that the one or more transfer ports 19 lie below the seal 10, with the castellated lower part 13 of the stem portion 7 abutting a stop ledge or flange 38 formed in the metering chamber 9. As described in conjunction with FIG. 2, the stem portion 8 moves further during filling, so that the seal 16 passes through the inlet duct 18 and allows the source of propellant connected to the end 12*a* to communicate with the interior of the aerosol container body (not shown).

As will be appreciated, the invention provides an aerosol valve having quick-fill/quick-empty properties and, also provides low pressure filling at pressures which are substantially lower than those which have to be used for the filling of many aerosol containers fitted with conventional valves. Of course, it will be appreciated that the presently inventive valve can also be used with cold-filled containers, wherein the valve assembly is secured to a previously filled container, rather than using the pressure filling method.

In particular, it has been found that an aerosol container to which a valve in accordance with the invention is attached, can be filled with fluid at substantially lower pressures than those used for filling with some conventional valves, where filling pressures have to be at least 600 psi.

I claim:

1. A dispensing device for dispensing metered fluid doses from an aerosol container, the device comprising a valve body at least partially defining a generally cylindrical metering chamber, and an inlet duct having a uniform diameter including a continuous annular upper section adjacent to the metering chamber and a lower section having an opening through the wall thereof, a valve stem slidably moveable within the metering chamber and the inlet duct of said valve body, said valve stem comprising a first, upper portion having an outlet duct and constituting a discharge tube and a second, lower portion positioned within the metering chamber adjacent to the inlet duct, first sealing means between said first stem portion and the valve body at a discharge end of the metering chamber, and second sealing means on said second stem portion for sealing engagement with said inlet duct, said first and second sealing means adapted to have (a) an operative position in which the first sealing means closes the discharge end of the metering chamber, the outlet duct is closed and the second sealing means is positioned within the metering chamber to open the inlet duct to receive fluid to be dispensed, (b) a dispensing position in which the upper stem portion is displaced into the metering chamber to communicate the outlet duct with the metering chamber and with the second sealing means in engagement with the inlet duct to seal off a predetermined quantity of fluid in the metering chamber for dispensation, and (c) a filling position in which displacement of the lower stem portion is such that said second sealing means passes completely through and out of the annular upper section of the inlet duct providing a passageway for the charging fluid which is unobstructed by said second sealing means.

2. A dispensing device as claimed in claim 1, wherein the first and second portions of the valve stem are separable whereby the lower stem portion is displaced away from the upper stem portion in the filling position relative to the position of the lower stem portion in the inoperative and dispensing positions.

3. A dispensing device as claimed in claim 1, in which the valve stem is at last partially castellated.

4. A dispensing device as claimed in claim 1, in which the first portion of the valve stem is provided with circumferential castellations within the metering chamber.

5. A dispensing device as claimed in claim 1, which includes a metallic liner for the metering chamber and for the inlet duct to the chamber.

6. A dispensing device as claimed in claim 1, wherein the second sealing means comprises an O-ring located in an annular groove in the second portion of the valve stem.

7. A dispensing device as claimed in claim 1, wherein the second sealing means comprises an annular radial projection of the lower stem portion.

8. A device as claimed in claim 1, which includes a dip tube attached to the valve body for communication with the outlet duct via the metering chamber and the inlet duct.

9. A dispensing device as claimed in claim 8, in which the diptube is attached to the valve body by means of a tubular member having one end secured to the valve body and its other end carrying an extension to which the diptube is secured, the interior of the tubular member being in communication with the interior of the extension and the diptube by way of a central inlet hole in the other end of the tubular member.

10. A dispensing device as claimed in claim 9, wherein said one end of the tubular member is a press-fit upon a reduced diameter part of the valve body.

11. A dispensing device as claimed in claim 9, wherein one end of the diptube is fitted over the outside of the extension.

12. A dispensing device as claimed in claim 9, in which the diptube is a capillary tube having one end fitted inside the bore of the extension.

* * * * *